US009097457B2

(12) United States Patent
Kim

(10) Patent No.: US 9,097,457 B2
(45) Date of Patent: Aug. 4, 2015

(54) REFRIGERATOR

(71) Applicant: Dongbu Daewoo Electronics Corporation, Seoul (KR)

(72) Inventor: Myeong Suk Kim, Bucheon-si (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 0 days.

(21) Appl. No.: 13/959,386

(22) Filed: Aug. 5, 2013

(65) Prior Publication Data

US 2014/0035454 A1 Feb. 6, 2014

(30) Foreign Application Priority Data

Aug. 6, 2012 (KR) ..... 10-2012-0085837

(51) Int. Cl.
*F25D 23/04* (2006.01)
*F25D 23/02* (2006.01)
*E05C 19/16* (2006.01)

(52) U.S. Cl.
CPC ..... *F25D 23/028* (2013.01); *E05C 19/16* (2013.01); *F25D 23/04* (2013.01)

(58) Field of Classification Search
CPC ..... E05C 19/16; F25D 23/04; F25D 23/028
USPC ..... 312/401, 404, 405, 405.1, 321.5; 292/251.5; 62/377
See application file for complete search history.

(56) References Cited

U.S. PATENT DOCUMENTS

| | | | | |
|---|---|---|---|---|
| 4,898,294 | A * | 2/1990 | Jennings | 220/592.09 |
| 5,765,390 | A * | 6/1998 | Johnson et al. | 62/441 |
| 7,472,974 | B2 * | 1/2009 | Czach et al. | 312/405.1 |
| 2004/0004421 | A1 * | 1/2004 | Han | 312/404 |
| 2006/0186775 | A1 * | 8/2006 | Becke et al. | 312/405.1 |
| 2006/0226749 | A1 * | 10/2006 | Kim | 312/404 |
| 2007/0182296 | A1 * | 8/2007 | Lee | 312/405.1 |
| 2008/0246381 | A1 * | 10/2008 | Kim | 312/405.1 |
| 2009/0033191 | A1 * | 2/2009 | Kim | 312/405.1 |
| 2009/0146538 | A1 * | 6/2009 | Lee et al. | 312/405.1 |
| 2010/0270902 | A1 * | 10/2010 | Kim et al. | 312/405.1 |

* cited by examiner

*Primary Examiner* — James O Hansen

(57) ABSTRACT

Disclosed therein is a refrigerator. The refrigerator includes: a refrigerator main body partitioned into a freezing room and a refrigeration room; a refrigerator door for opening and closing the refrigerator main body; pockets mounted on the inner face of the refrigerator door; and a sealing room provided to the pocket for separately storing articles by stopping a flow of cold air of the refrigerator main body.

8 Claims, 4 Drawing Sheets

REFRIGERATOR

BACKGROUND OF THE INVENTION

1. Field of the Invention

The present invention relates to a refrigerator, and more particularly, to a refrigerator which keeps foods in a refrigerated state and in a frozen state using a heat-exchanging action of refrigerant by a refrigeration cycle.

2. Background Art

In general, a refrigerator keeps foods contained in a refrigeration room and a freezing room by repeating a refrigeration cycle of compressing, condensing, expanding and evaporating refrigerant so as to lower temperature inside the refrigeration room and in the freezing room.

Doors are respectively mounted on the opened front faces of the freezing room and the refrigeration room, and a plurality of door pockets for storing foods are arranged on the inner walls of the doors in a vertical direction.

However, conventional refrigerators have several problems in that articles stored in the door pockets are exposed to smells of foods stored in the refrigerator and in that the articles are influenced by the inside temperature of the refrigerator even though they must be kept at temperature different from the temperature of the inside temperature of the refrigerator.

CITED REFERENCES

Cited Reference 1

Korean Utility Model Laid-open No. 2000-0010537 (Jun. 15, 2000)

SUMMARY OF THE INVENTION

Accordingly, the present invention has been made to solve the above-mentioned problems occurring in the prior arts, and it is an object of the present invention to provide a refrigerator which includes door pockets respectively having a sealing room for stopping cold air and bad smells inside the rooms of the refrigerator.

To achieve the above objects, the present invention provides a refrigerator including: a refrigerator main body partitioned into a freezing room and a refrigeration room; a refrigerator door for opening and closing the refrigerator main body; pockets mounted on the inner face of the refrigerator door; and a sealing room provided to the pocket for separately storing articles by stopping a flow of cold air of the refrigerator main body, wherein the sealing room includes: a housing having an opened front face; a sealing member arranged on the edge portions of the opened front face of the housing; and a housing door for opening and closing the opened front face of the housing.

The refrigerator further includes: first magnetic bodies arranged on the inner face of the opened front face of the housing: and second magnetic bodies arranged on the housing door and causing a magnetic pulling power with the first magnetic bodies, wherein the housing door compresses the sealing member against the opened front face of the housing by the magnetic pulling power between the first magnetic bodies and the second magnetic bodies.

The first magnetic bodies are respectively arranged at both sides of the lower end portion of the opened front face of the housing, and the second magnetic bodies are respectively arranged at both sides of the lower end portion of the housing door in such a way as to be opposite to the first magnetic bodies.

The sealing room is arranged in the pocket in such a fashion that the housing door is opposite the refrigerator main body, and the pocket has an opened portion formed in such a way as to be opposite to the housing door.

The housing door is hinge-joined to the upper end portion of the opened front face of the housing.

A hand-grip is protrudingly formed at the lower end portion of the housing door.

The sealing room further includes a plurality of partitions for partitioning the inner space of the housing into several spaces.

As described above, the refrigerator according to the present invention can prevent smells of articles stored in the sealing room and articles stored in the rooms of the refrigerator from being mixed together.

Moreover, the refrigerator according to the present invention can keep the articles stored in the sealing room and the articles stored in the rooms of the refrigerator at different temperatures.

BRIEF DESCRIPTION OF THE DRAWINGS

For the purposes of illustrating the preferred embodiment of the disclosure, reference is made to the drawings, but it should be understood that the present invention is not limited to the illustrated embodiment and drawings, in which.

DETAILED DESCRIPTION OF THE PREFERRED EMBODIMENT

Figure 1:
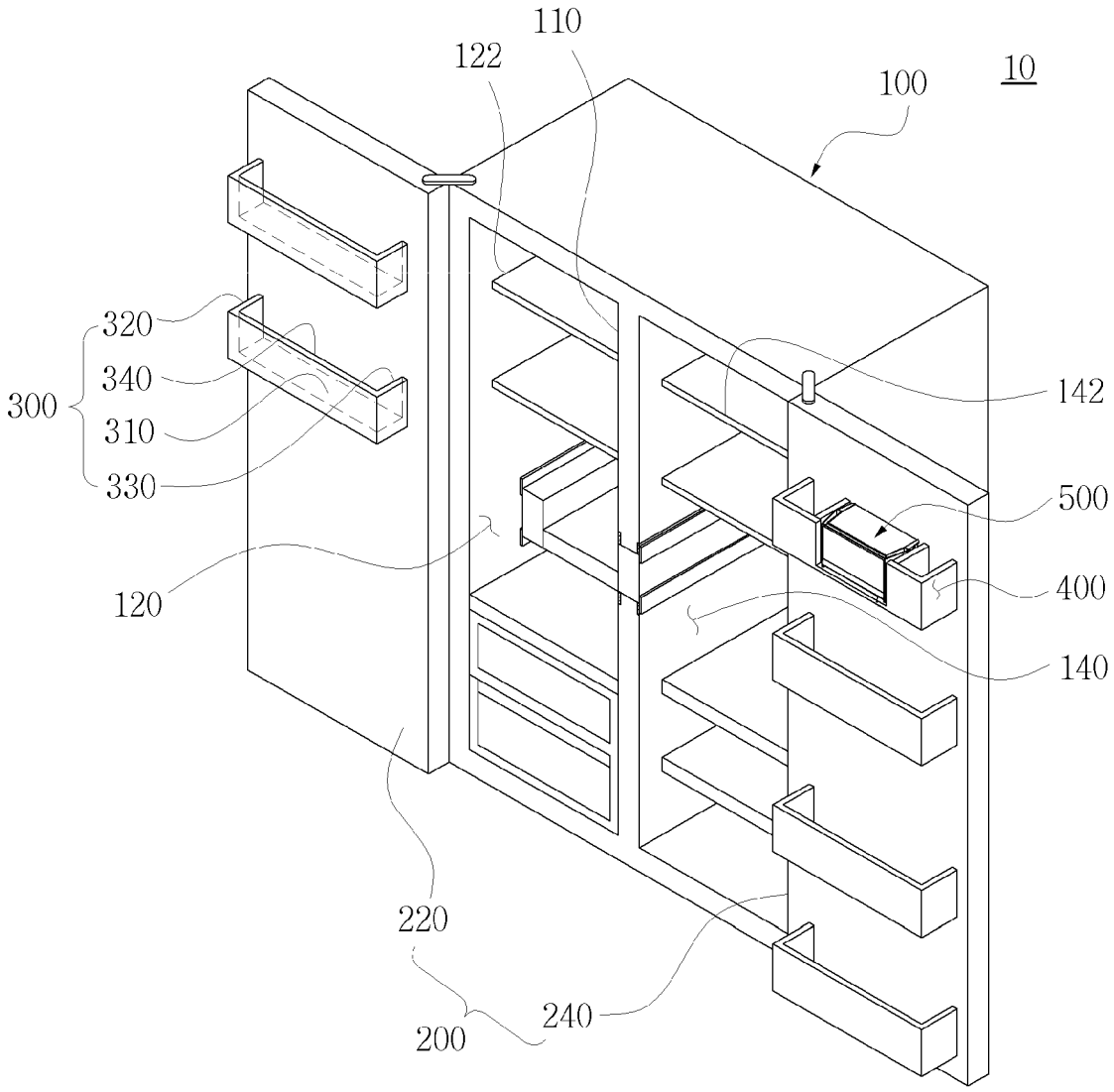
FIG. 1 is a perspective view of a refrigerator according to a preferred embodiment of the present invention.

Reference will be now made in detail to a refrigerator according to the preferred embodiment of the present invention with reference to the attached drawings. First, in the drawings, the same components have the same reference numerals even though they are illustrated in different figures. In addition, in the description of the present invention, when it is judged that detailed descriptions of known functions or structures related with the present invention may make the essential points vague, the detailed descriptions of the known functions or structures will be omitted.

Embodiment

FIG. 1 is a perspective view of a refrigerator according to a preferred embodiment of the present invention.

Referring to FIG. 1, the refrigerator 10 according to the present invention includes a refrigerator main body 100, a refrigerator door 200, first and second pockets 300 and 400, and a sealing room 500.

The refrigerator main body 100 has a cuboid shape opened at the front face, and its inner space is divided into a freezing room 120 and a refrigeration room 140 by a vertical partition wall 110. The freezing room 120 stores foods frozen and the refrigeration room 140 stores foods refrigerated. The freezing room 120 and the refrigeration room 140 respectively have a plurality of shelves 122 and 142 for keeping foods in safety, and the plural shelves 122 and 142 are spaced from one another in a vertical direction.

The refrigerator door 200 includes a freezing room door 220 for opening and closing the freezing room 120 and a refrigeration room door 240 for opening and closing the refrigeration room 140. The freezing room door 220 is rotatably hinge-joined to a side wall of the freezing room 120 which is opposite to the partition wall 110, and the refrigeration room door 240 is rotatably hinge-joined to a side wall of the refrigeration room 140 which is opposite to the partition wall 110.

A plurality of the first pockets 300 are mounted on the inner wall of the freezing room door 220 in such a way as to be spaced apart from one another in the vertical direction, and store relatively small-sized foods to be kept under a frozen condition. Each of the first pockets 300 includes a bottom plate 310, first side plates 320 and 330, and second side plates 340. The first bottom plate 310 has a rectangular shape and arranged horizontally, and one of long sides of the first bottom plate 310 is joined to the inner wall of the freezing room door 220. The first side plates 320 and 330 extend upward in a vertical direction from short sides of the first bottom plate 310, and the second side plate 340 extends upward in the vertical direction from the other one of the long sides of the first bottom plate 310. The bottom plate 310, the first side plates 320 and 330 and the second side plate 340 form a receiving space opened at the top with inner wall of the freezing room door 220, and the receiving space stores and keeps foods in a frozen state.

A plurality of the second pockets 400 are mounted on the inner wall of the refrigeration room door 240 in such a way as to be spaced apart from one another in the vertical direction. Moreover, the second pockets 400 store relatively small-sized foods to be kept under a refrigerated condition, and especially, store cans filled with drinking water or bottle-shaped containers. Because the second pockets 400 substantially have the same shape as the first pockets 300, the detailed description of the second pockets 400 will be omitted.

The sealing room 500 is provided in the second pocket 400, and separately stores articles by stopping a flow of cold air of the refrigeration room 140. The articles separately stored in the sealing room 500 may be cosmetics. In this embodiment, as an example, the sealing room 500 is provided in the second pocket 400, but the sealing room 500 may be provided in the first pocket 300.

The sealing room 500 is arranged in the second pocket 400 in such a fashion that a housing door which will be described later faces the refrigeration room 140, and the second pocket 400 may have an opened portion which is opposite to the housing door of the sealing room 500. If the opened portion is formed at the second pocket 400, it can prevent interference between the housing door of the sealing room 500 and the second pocket 400.

Figure 2:
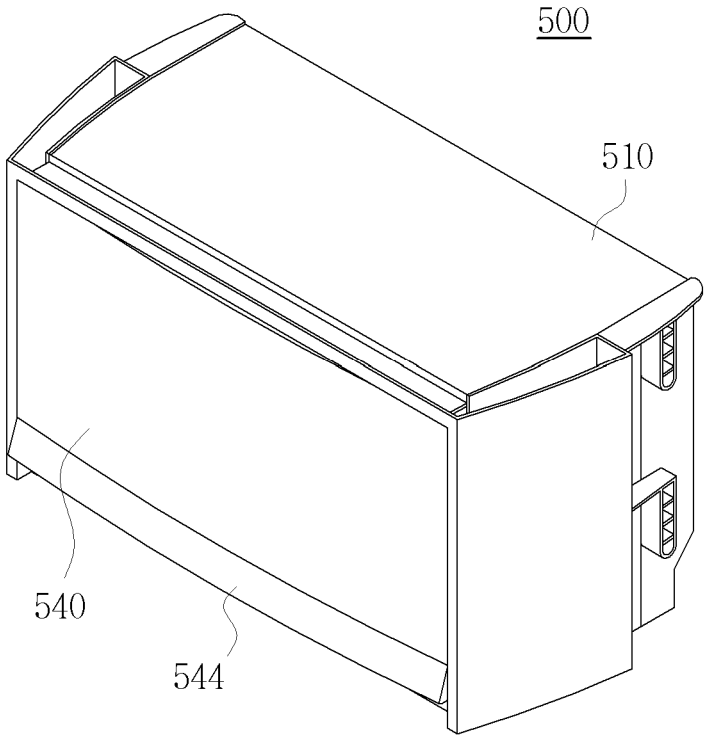
FIG. 2 is a perspective view of a sealing room of FIG. 1.
Figure 3:
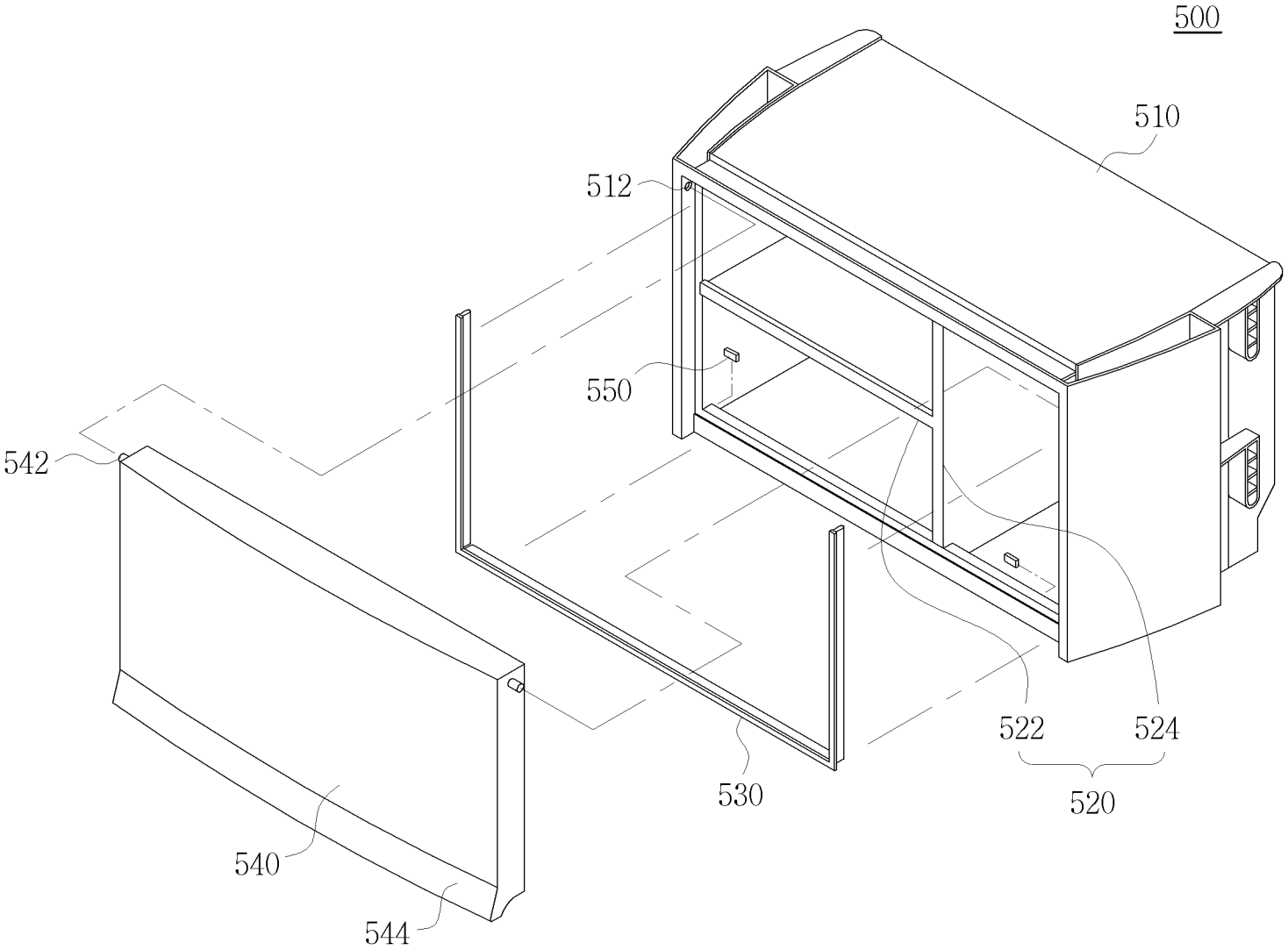
FIG. 3 is an exploded perspective view of the sealing room FIG. 2.
Figure 4:
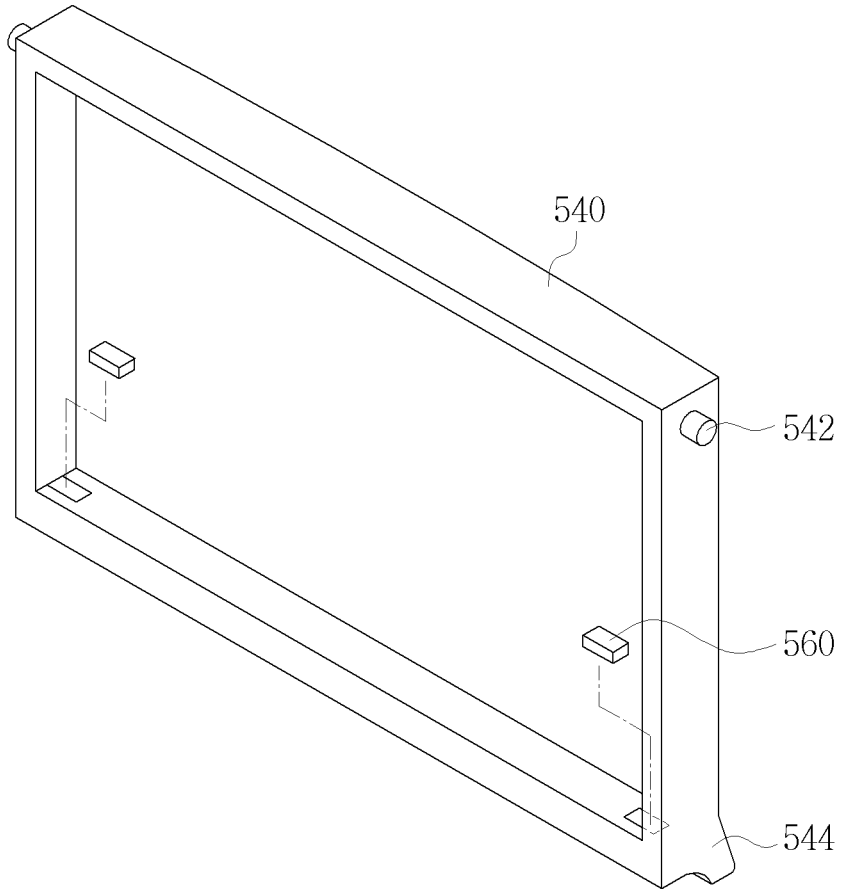
FIG. 4 is a rear perspective view of a housing door of FIG. 3.

FIG. 2 is a perspective view of a sealing room of FIG. 1, FIG. 3 is an exploded perspective view of the sealing room FIG. 2, and FIG. 4 is a rear perspective view of a housing door of FIG. 3.

Referring to FIGS. 2 to 4, the sealing room 500 includes a housing 510, partitions 520, a sealing member 530, the housing door 540, and first and second magnetic bodies 550 and 560.

The housing 510 may have an approximately cuboid shape, and is opened at the front face. The partitions 520 include a horizontal partition 522 and a vertical partition 524. The horizontal partition 522 divides the inner space of the housing 510 into an upper part and a lower part, and the vertical partition 524 divides the inner space of the housing 510 into a right part and a left part. The inner spaces of the housing 510 divided by the horizontal and vertical partitions 522 and 524 store articles therein.

The sealing member 530 is in an approximately "U" shape, and is arranged on edge portions of the opened front face of the housing 510. In other words, the sealing member 530 is arranged at right and left sides and the bottom portion of the opened front face of the housing 510. The sealing member 530 may be a gasket and stops a flow of cold air between the housing 510 and the housing door 540. Accordingly, the refrigerator according to the present invention can prevent the cold air and smells inside the refrigeration room 140 from flowing into the sealing room 500.

The housing door 540 opens and closes the opened front face of the housing 510. The housing door 540 may be hinge-joined to the upper end portion of the opened front face of the housing 510. In detail, hinge protrusions 542 are protrudingly formed at both sides of the upper end portion of the housing door 540, and joining holes 512 in which the hinge protrusions 542 are inserted are formed at both sides of the upper end portion of the opened front face of the housing 510. Furthermore, a hand-grip 544 for allowing a user to grasp it with the hand may be protrudingly formed at the lower end portion of the housing door 540.

The first magnetic bodies 550 may be arranged at the lower end portion of the opened front face of the housing 510. In detail, the first magnetic bodies 550 may be respectively arranged at both sides of the lower end portion of the opened front face of the housing 510. The second magnetic bodies 560 are arranged on the housing door 540 in such a way as to be opposite to the first magnetic bodies 550. In detail, the second magnetic bodies 560 may be respectively arranged at both sides of the lower end portion of the housing door 540 in such a way as to be opposite to the first magnetic bodies 550.

Magnetic pulling power acts between the first magnetic bodies 550 and the second magnetic bodies 560. For instance, in the case that the opposite first magnetic bodies 550 have a N pole, the opposite second magnetic bodies 560 may have a S pole. On the contrary, in the case that the opposite first magnetic bodies 550 have a S pole, the opposite second magnetic bodies 560 may have a N pole.

As described above, when the magnetic pulling power acts between the first magnetic bodies 550 and the second magnetic bodies 560, the housing door 540 compresses the sealing member 530 against the opened front face of the housing 510 so as to prevent an inflow of the cold air and smells between the housing 510 and the housing door 540. In the meantime, because the inflow of the cold air of the refrigeration room 140 between the housing 510 and the housing door 540 is prevented, the inside temperature of the sealing room 500 can be kept higher than temperature of the refrigeration room 140.

As described above, while the present invention has been particularly shown and described with reference to the example embodiments thereof, it will be understood by those of ordinary skill in the art that the above embodiments of the present invention are all exemplified and various changes, modifications and equivalents may be made therein without changing the essential characteristics and scope of the present invention. Therefore, it would be understood that the embodiments disclosed in the present invention are not to limit the technical idea of the present invention but to describe the present invention, and the technical and protective scope of the present invention shall be defined by the illustrated embodiments. It should be also understood that the protective scope of the present invention is interpreted by the following claims and all technical ideas within the equivalent scope belong to the technical scope of the present invention.

What is claimed is:

1. A refrigerator comprising:

a refrigerator main body partitioned into a freezing room and a refrigeration room;

a refrigerator door for opening and closing the refrigerator main body;

pockets mounted on an inner face of the refrigerator door; and a sealing room interposed horizontally between two of the pockets for separately storing articles by stopping a flow of cold air of the refrigerator main body, wherein the sealing room comprises:

a housing having an opened front face;

a sealing member arranged on edge portions of the opened front face of the housing; and a housing door for opening and closing the opened front face of the housing, wherein magnetic bodies are installed in at least one of the housing and the housing door so that the housing door compresses the sealing member against the opened front face of the housing due to the magnetic pulling force of the magnetic bodies.

2. The refrigerator according to claim 1, wherein the magnetic bodies comprise:

first magnetic bodies arranged at both sides of an inner part of the opened front face of the housing; and second magnetic bodies arranged at both sides of a lower end portion of the housing door and causing the magnetic pulling force with the first magnetic bodies.

3. The refrigerator according to claim 2, wherein the first magnetic bodies are respectively arranged at both sides of a lower end portion of the opened front face of the housing, and the second magnetic bodies are respectively arranged at both sides of the lower end portion of the housing door in such a way as to be opposite to the first magnetic bodies.

4. The refrigerator according to claim 1, wherein the sealing room is arranged between the pockets in such a fashion that the housing door is opposite to the refrigerator main body.

5. The refrigerator according to claim 1, wherein the housing door is hinge-joined to an upper end portion of the opened front face of the housing.

6. The refrigerator according to claim 5, wherein a handgrip is protrudingly formed at a lower end portion of the housing door.

7. The refrigerator according to claim 1, wherein the sealing room further comprises a plurality of partitions for partitioning the inner space of the housing into several spaces.

8. The refrigerator according to claim 1, wherein a temperature inside the sealing room is higher than a temperature of the refrigeration room.

* * * * *